US006260290B1

(12) United States Patent
Chenevert

(10) Patent No.: US 6,260,290 B1
(45) Date of Patent: Jul. 17, 2001

(54) QUARTER FOR SKATE BOOT

(75) Inventor: François Chenevert, Blainville (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/486,919

(22) PCT Filed: Sep. 4, 1998

(86) PCT No.: PCT/CA98/00845

§ 371 Date: Mar. 6, 2000

§ 102(e) Date: Mar. 6, 2000

(87) PCT Pub. No.: WO99/12439

PCT Pub. Date: Mar. 18, 1999

(30) Foreign Application Priority Data

Sep. 5, 1997 (CA) ..... 2214748

(51) Int. Cl.[7] ..... A43B 23/00; A43B 5/04; A43D 31/00

(52) U.S. Cl. ..... 36/115; 36/117.1; 36/117.2; 36/45; 36/47; 12/146 C

(58) Field of Search ..... 12/145, 146 R, 12/146 C; 36/115, 116, 117.1, 117.2, 109, 45, 46.5, 47, 48, 49, 55, 10

(56) References Cited

U.S. PATENT DOCUMENTS

| | | | | |
|---|---|---|---|---|
| 206,292 | * | 7/1878 | Anglemire | 36/47 |
| 214,264 | * | 4/1879 | Springer | 12/146 C |
| 440,409 | * | 11/1890 | McSwyny | 36/48 |
| 731,650 | * | 6/1903 | Yon | 36/45 |
| 983,576 | * | 2/1911 | Smith | 36/48 |
| 1,258,024 | * | 3/1918 | Laybourn | 36/49 |
| 1,952,628 | * | 3/1934 | MacDonald | 12/146 C |
| 2,211,822 | | 8/1940 | Jennings . | |
| 2,915,835 | * | 12/1959 | Snitzer | 36/45 |
| 4,194,308 | * | 3/1980 | Karlsson | 36/48 |
| 4,385,456 | | 5/1983 | Livernois et al. . | |

FOREIGN PATENT DOCUMENTS

| | | | | |
|---|---|---|---|---|
| 675170 | | 5/1966 | (BE) . | |
| 132884 | | 7/1929 | (CH) . | |
| 158523 | | 6/1933 | (CH) . | |
| 94 00 085 U | | 4/1994 | (DE) . | |
| 23013 | * | 4/1918 | (DK) | 36/47 |

* cited by examiner

*Primary Examiner*—Paul T. Sewell
*Assistant Examiner*—Anthony Stashick
(74) *Attorney, Agent, or Firm*—Ratner & Prestia

(57) ABSTRACT

A one-piece quarter for a lasted skate boot. The quarter comprises a quarter medial portion and a quarter lateral portion. The quarter medial and quarter lateral portions each comprise, respectively, foxing medial and lateral portions. A tendon guard is disposed in the upper portion of the quarter. This tendon guard is preferably sewn to the quarter. Therefore, the guard is attached to the quarter along the junction line. According to the invention, with a quarter consisting of only one piece, there is no sewing line along the symmetry line. The skate boot provided with such a quarter features a stronger heel portion, without any risk of a broken sewing line. The skate boot is less expensive to manufacture, with at least one sewing step eliminated.

7 Claims, 3 Drawing Sheets

QUARTER FOR SKATE BOOT

This is the U.S. National Phase of International Application No. PCT/CA98/00845, filed on Sep. 4, 1998.

FIELD OF THE INVENTION

The present invention relates to a quarter for a lasted skate boot. It also relates to the skate boot comprising such a quarter.

BACKGROUND OF THE INVENTION

The prior art quarter were consisting of many separate components. A medial quarter 1 (FIG. 1) and a lateral quarter 2 were manufacture separate parts. The rear extremities 5 of these parts, corresponding to the heel and ankle portions of the foot, were then sewn together. A tendon guard 3, also manufactured as a separate part, was finally disposed on the top end of the assembly. With such a realization, the rear part of the skate boot was provided with a sewing line 4, presenting many disadvantages. For example, the sewing line was difficult to realize when using rigid materials. Moreover, the cambered shape of these elements caused many difficulties to realize the sewing line. Furthermore, the boot integrity was considerably affected by the presence of a sewing line at the rear part of the boot, this area being subject to very strong constraints. This sewing line was subject to breaking, causing considerable damage to the skate boot. During the assembly process, there was a high probability that the operator set together two similar parts, instead of one medial and one lateral quarters, these parts being very similar. The quality control requirements were very strict, to ensure that the sewing lines were exactly in a straight line. According to prior art realizations, the tendon guard was also placed over the quarters, forming an overlap 6. This implied additional use of material, additional weight, etc.

Considering the importance of the quarter to produce a high quality skate boot, there is a strong demand for an improved quarter.

OBJECTS AND STATEMENT OF THE INVENTION

It is thus an object of the invention to provide a quarter for skate boot avoiding the above mentioned drawbacks.

It is another object of the invention to provide an ice skate boot or a roller skate boot provided with such a quarter.

As embodied and broadly described herein, the invention provides a quarter for a lasted skate boot, said quarter being adapted to encircle the heel and ankle portions of a wearer's foot, said quarter comprising a quarter medial portion, a quarter lateral portion, a junction line between said portions, said portions being integrally connected at said junction line.

A skate boot provided with such a quarter has a stronger heel portion, without any risk of broken sewing line. It is less expensive to manufacture, with at least one sewing step eliminated. There is no necessity to add additional material to protect the sewing line.

Advantageously, the portions extend upwardly along said junction line, and outwardly each side of said line along a narrowing profile adapted to the rear shape a skate boot when folded in U-shape.

The lateral and medial portions respectively, are preferably provided with a foxing medial and lateral portions, extending downwardly from said quarter medial and lateral portions.

A tendon guard is advantageously provided in the upper portion of the quarter. The tendon guard may be partially sewn to the upper portion of the quarter before assembly to the skate boot. The tendon guard and the quarter are connected side by side.

DETAILED DESCRIPTION OF PREFERRED EMBODIMENTS

The skate boot, according to the invention, avoids these drawbacks. According to the invention, the quarter 10 is provided in one piece. It comprises a quarter medial portion 11, and a quarter lateral portion 13. The quarter medial portion 11 and lateral portion 13 comprise respectively a foxing medial and lateral portions 12 and 14. The junction line between the lateral and medial portions defines a symmetry line 15.

In a variant, a tendon guard 20 is disposed in the upper portion of the quarter. This tendon guard is preferably sewn to the quarter. The guard is therefore attached to the quarter, along with the junction line 21. This junction line is preferably formed by the top bordering of the upwardly extending central section of the quarter. Furthermore, the guard is advantageously disposed side by side with the quarter. This type of joint avoids the formation of any overlapping of the two assembled parts.

According to the invention, with a quarter consisting of only one piece, there is no sewing line along the symmetry line 15.

The two foxing medial and lateral portions 12 and 14 are advantageously joined together with a sewing line. This assembly line provides an advantageous curved shape for the heel area. For more resistance, the guard and the foxing portions are sewn, in the form of zigzags or saw teeth.

This improved skate boot features a stronger heel portion, without any risk of broken sewing line. It is less expensive to manufacture, with at least one sewing step eliminated. There is no necessity to add additional material to protect the sewing line.

As embodied and broadly described herein, the invention also provides a skate boot comprising a sole, a front portion for enclosing the toes of a wearer's foot, a rear portion for enclosing the heel of a wearer's foot, side walls extending longitudinally between said front and heel portions, the rear portion comprising a quarter as previously defined.

Other objects and features of the invention will become apparent by reference to the following description and the drawings.

BRIEF DESCRIPTION OF THE DRAWINGS

A detailed description of the preferred embodiments of the present invention is provided hereinbelow, by way of example only, with reference to the accompanying drawings, in which.

Figure 1:
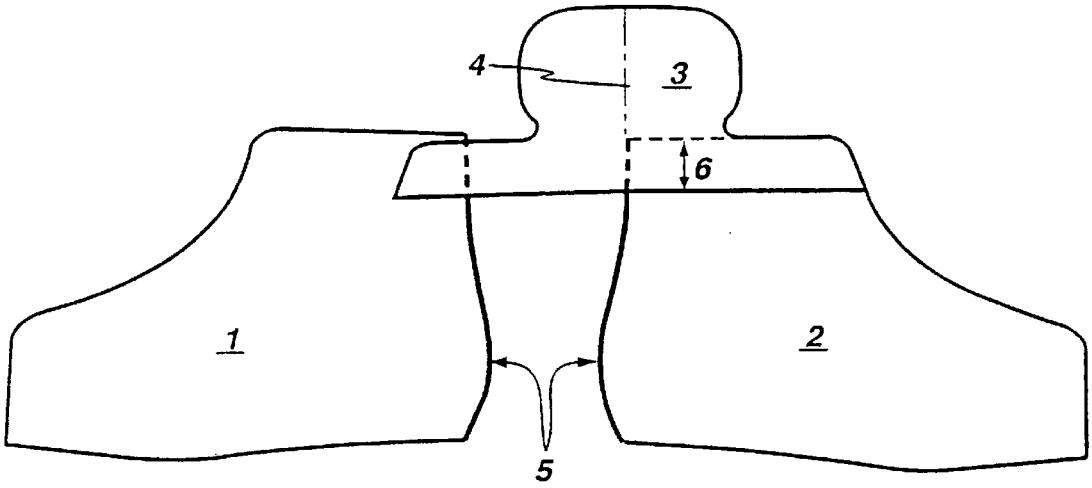
Fig.1 Prior Art
FIG. 1 is an elevational view of a quarter of a prior art quarter.
Figure 2:
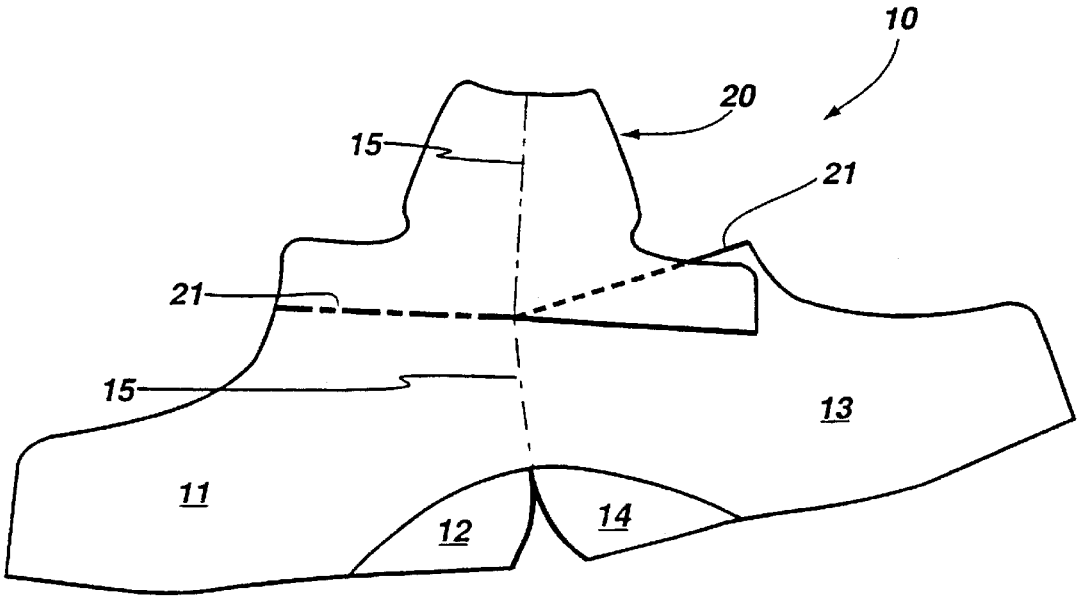
FIG. 2 is an elevational view of a quarter according to the invention.
Figure 3:
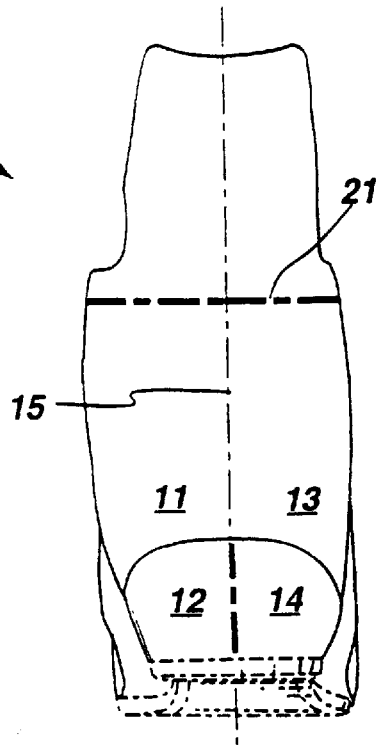
FIGS. 3 and 4 are elevational views of a skate boot with a quarter according to the invention.
Figure 4:
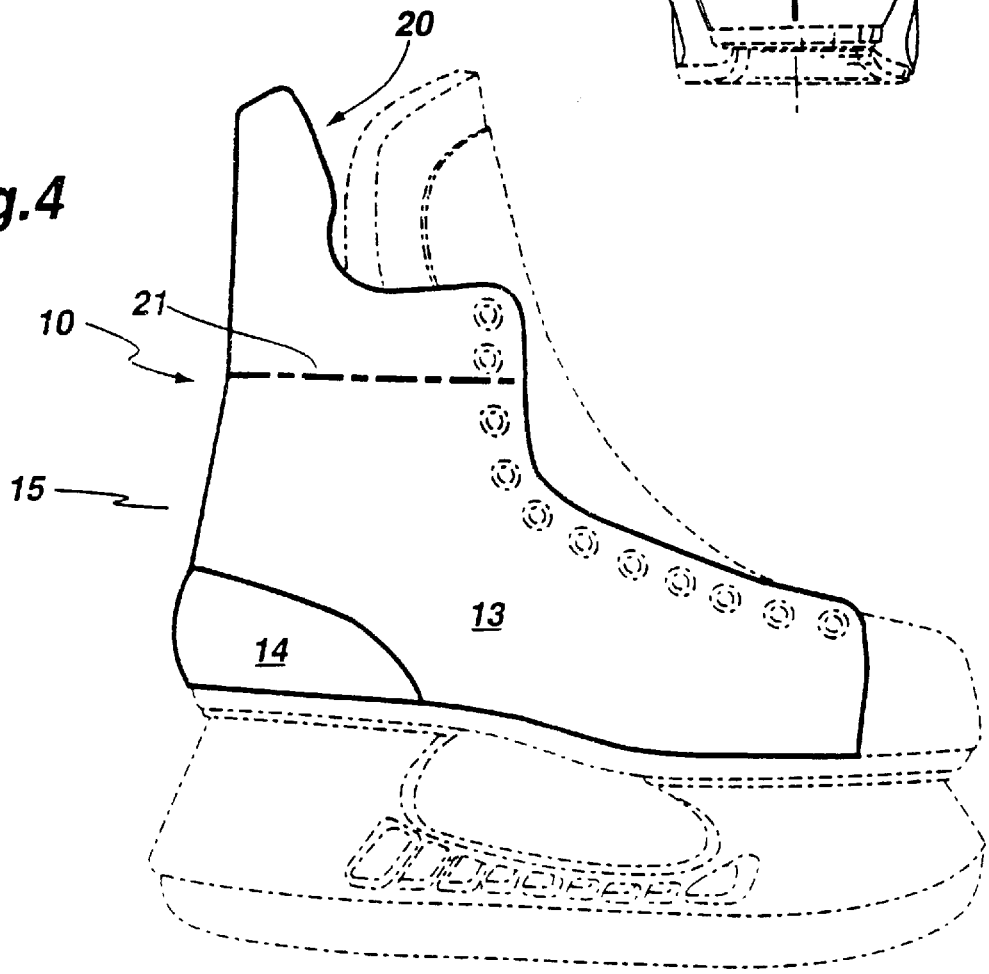
Figure 5:
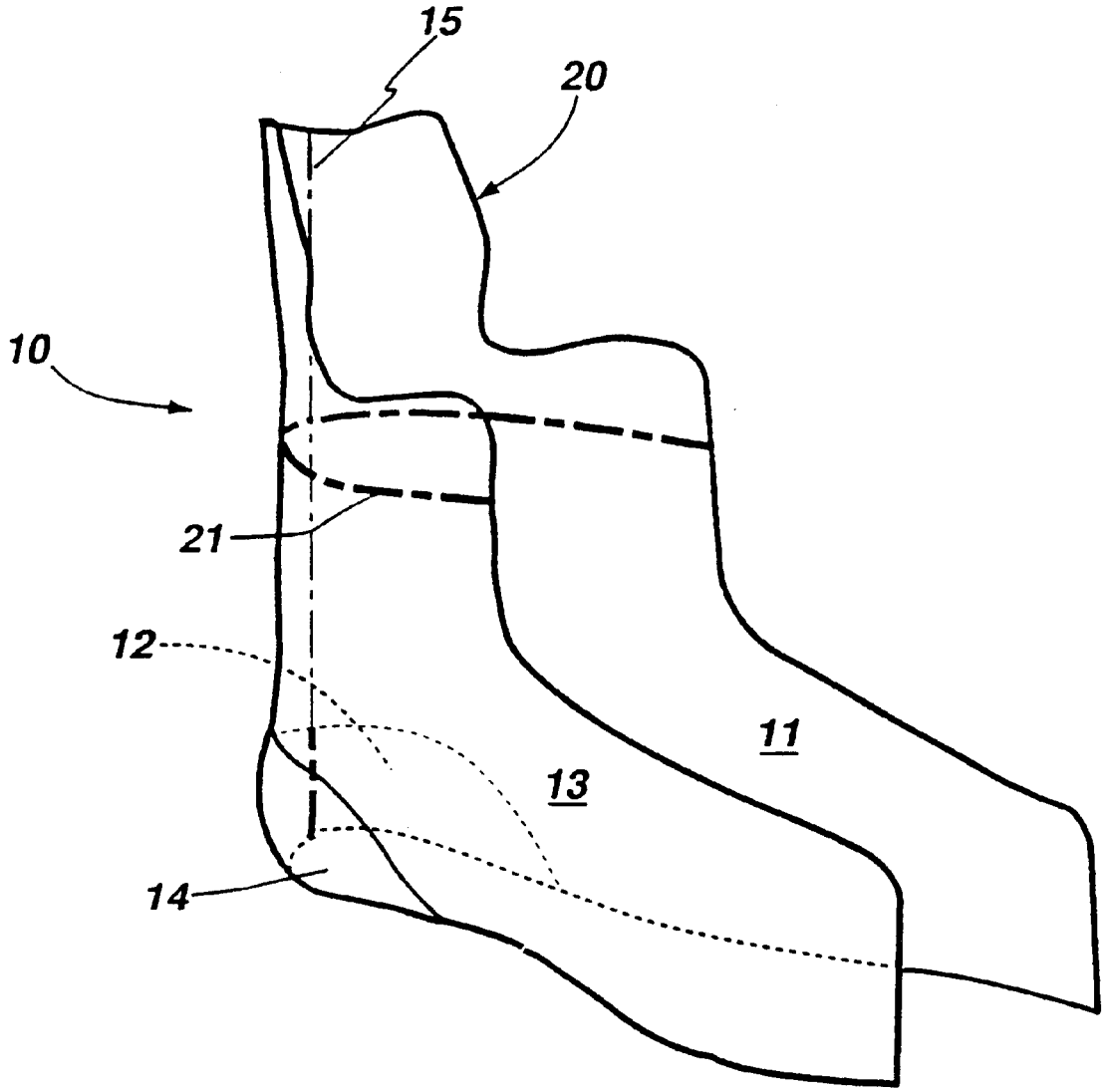
FIG. 5 illustrates a perspective view of a quarter according to the invention preformed before assembly to the skate boot.

In the drawings, preferred embodiments of the invention are illustrated by way of examples. It is to be expressly understood that the description and drawings are only for the purpose of illustration and are an aid. for understanding. They are not intended to be a definition of the limits of the invention.

The quarter may be manufactured with different materials, for example with a multi-layer composite comprising fibres, polymer and nylon, preferably by dye-cut.

To complete the skate, the quarter is formed, sewn to the upper of the boot. The sole is then glued to the upper. Finally, the blade assembly is riveted to the sole.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A skate boot comprising a sole, a front portion for enclosing a wearer's toes, a rear portion for enclosing a wearer's heel and ankle, and a medial and lateral portion for enclosing the sides of a wearer's foot, said rear portion and said medial and lateral portions comprising:

a quarter medial portion and a quarter lateral portion integrally connected together in a one-piece construction and being folded at a symmetry line to form a U-shaped skate boot structure, each of said quarter portions extending upwardly along said symmetry line defining a heel and ankle portion of said skate boot structure and extending outwardly from said symmetry line in a narrowing profile for defining both sides of said skate boot structure; and a tendon guard secured to said quarter medial portion and quarter lateral portion at a junction line in a side-by-side fashion thereby resulting in said rear portion of said skate boot having an obtuse angular profile defined by said tendon guard and said quarter medial and lateral portions at said junction line.

2. The skate boot as defined in claim 1 wherein an upper edge of said quarter medial portion defines, with an upper edge of said quarter lateral portion, an angle which is different from an angle defined by a lower edge of said tendon guard such that when said tendon guard is secured to said quarter medial portion and said quarter lateral portion in a side-by-side fashion, said tendon guard defines an obtuse angle with said quarter medial portion and quarter lateral portion.

3. The skate boot as defined in claim 2 wherein said angle defined by the upper edges of said quarter lateral and medial portions is less than 180 degrees and said angle defined by said lower edge of said tendon guard is at least 180 degrees.

4. The skate boot as defined in claim 3 further comprising a medial foxing portion and a lateral foxing portion in a lower area of their respective quarter portions, said foxing portions being sewn together after said quarter lateral and medial portions have been shaped, to form a curved heel profile.

5. The skate boot as defined in claim 3 wherein said tendon guard, when assembled with said U-shaped skate boot structure, defines an obtuse angle at said junction line.

6. A method of fabricating a skate boot comprising the steps of:

cutting a one-piece element comprising a quarter medial portion, a quarter lateral portion, a medial foxing portion, and a lateral foxing portion, said quarter medial portion and said quarter lateral portion, together defining an upper edge of said one-piece element;

cutting a tendon guard having a lower edge;

folding said one-piece element at a symmetry line to form a U-shaped structure;

sewing said lower edge of said tendon guard to said upper edge of said one-piece element end-to-end to form a butt joint at a junction line, such that said tendon guard defines an obtuse angle with said one-piece element; and sewing together said medial foxing portion and lateral foxing portion to form a curved heel profile.

7. The method as defined in claim 6 wherein, prior to folding said one-piece element, said lower edge of said tendon guard is partially sewn to said upper edge of said quarter lateral and medial portions end-to-end to form a partial butt joint at the junction line.

* * * * *

UNITED STATES PATENT AND TRADEMARK OFFICE

CERTIFICATE OF CORRECTION

PATENT NO. : 6,260,290 B1
DATED : July 17, 2001
INVENTOR(S) : Francois Chenevert It is certified that error appears in the above-identified patent and that said Letters Patent is hereby corrected as shown below:

Column 4, claim 14,
(now renumbered as claim 8) has been omitted as added in the February 8, 2001 amendment.

-- 8. The skate boot as defined in claim 2 wherein said angle defined by the upper edges of said quarter lateral and medial portions is more than 180 degrees and said angle defined by said lower edge of said tendon guard is at most 180 degrees. --

Signed and Sealed this

Second Day of April, 2002

*Attest:*

*Attesting Officer*

JAMES E. ROGAN
*Director of the United States Patent and Trademark Office*